US005837916A

United States Patent [19]

Noakes, Jr.

[11] Patent Number: 5,837,916

[45] Date of Patent: Nov. 17, 1998

[54] NOAKES SPENT PRIMER DISCHARGE HOLE APPARATUS

[76] Inventor: Everett Noakes, Jr., 3216 Upper Fords Crk Rd., Orofino, Id. 83544

[21] Appl. No.: 688,947

[22] Filed: Oct. 30, 1996

[51] Int. Cl.[6] ..... F42B 33/10; F42B 33/02

[52] U.S. Cl. ..... 86/37; 86/23; 86/25; 86/28

[58] Field of Search ..... 86/36, 37, 38, 86/23, 25, 26, 27, 28

[56] References Cited

U.S. PATENT DOCUMENTS

| | | | |
|---|---|---|---|
| 1,463,603 | 7/1923 | Talcott | 86/23 |
| 3,124,994 | 3/1964 | Kiess, Jr. | 86/36 |
| 4,078,472 | 3/1978 | Simpson | 86/38 |
| 4,329,906 | 5/1982 | Heers | 86/36 |
| 4,512,235 | 4/1985 | Lee et al. | 86/37 |
| 4,590,841 | 5/1986 | Davis | 86/36 |
| 4,766,798 | 8/1988 | David et al. | 86/36 |
| 4,887,509 | 12/1989 | Hodulik | 86/36 |
| 4,890,534 | 1/1990 | Bender | 86/36 |

*Primary Examiner*—Charles T. Jordan
*Assistant Examiner*—Theresa M. Wesson

[57] ABSTRACT

An apparatus and method for facilitating the removal of spent primers from a press having a ram is disclosed. The method comprises the steps of punching a primer hole at a specified location, drilling the primer hole to a specified diameter and specified angle, drilling the hole to a larger diameter, inserting a piece of thin wall tubing into the primer hole, attaching a length of plastic tubing to the thin wall tubing and extending a lower end of the plastic tubing into a receptacle of choice.

1 Claim, 5 Drawing Sheets

NOAKES SPENT PRIMER DISCHARGE HOLE APPARATUS

BACKGROUND OF THE INVENTION

1. Field of Invention

My improvement (invention) to any C or H reloading press facilitates the removing of a spent primer and debris causing it to fall by gravity thru a ⅜" clear plastic tube and into a receptacle of choice and when reloading shells a person does not litter his surroundings with debris, particles and spent primers, burnt powder, grit and dust but all will be contained in a receptacle of choice. This invention clearly improves the environment around decapping shells that will be reloaded. This method is tested, is foolproof and works without difficulty.

2. Description of Prior Art

One reloading press has a very small (inadequate sized) plastic tray held to the reloader by a rubber band that invariably falls off and spills primers, debris all over the floor. This method is certainly inadequate if one wants to reload a quantity of shells and with one ill placed bump, all the primers and dust litter your area of reloading. To my knowledge there are no clean methods of retriving said primer, debris and fragments and dust until my invention.

SUMMARY OF THE INVENTION

This invention, which modifies any C or H press (Tourette Presses not included), to easily convert said C or H press from spilling primers and debris on the floor of the area of shell decapping and reloading to become a mess-free operation. The invention of drilling a hole in the frame of the C or H press and adding the plastic tubing to facilitate removal of primers and debris by gravity to the holding receptacle is simple and will completely improve the environment of the area for decapping shells and reloading same.

BRIEF DESCRIPTION OF THE DRAWINGS

FIG. 2*a* is a top view of the base of any C or H press, showing the addition of the hole drilled through.

DETAILED DESCRIPTION

FIG. 1-10 shows the original reloading die hole in C or H press.

FIG. 1-12 shows the ¾" deep hole. The ½" drill goes down ¾" deep into the frame of the C or H press.

FIG. 1-14 shows the position of Ram after ½" hole is drilled into C or H press.

FIG. 1-15 shows the Ram original part of any C or H press.

FIG. 1-16 shows the frame of any C or H press. FIG. 1*a*-10 shows the original reloading die hole in any C or H press.

FIG. 1*a*-12 shows the ¾" deep hole ½" diameter drilled into the frame of a C or H press.

FIG. 1*a*-11 shows the angle of drilled hole in any C or H press.

FIG. 1*a*-17 shows the ⅜" thin wall plastic tubing approximately 4" long.

Figure 1:
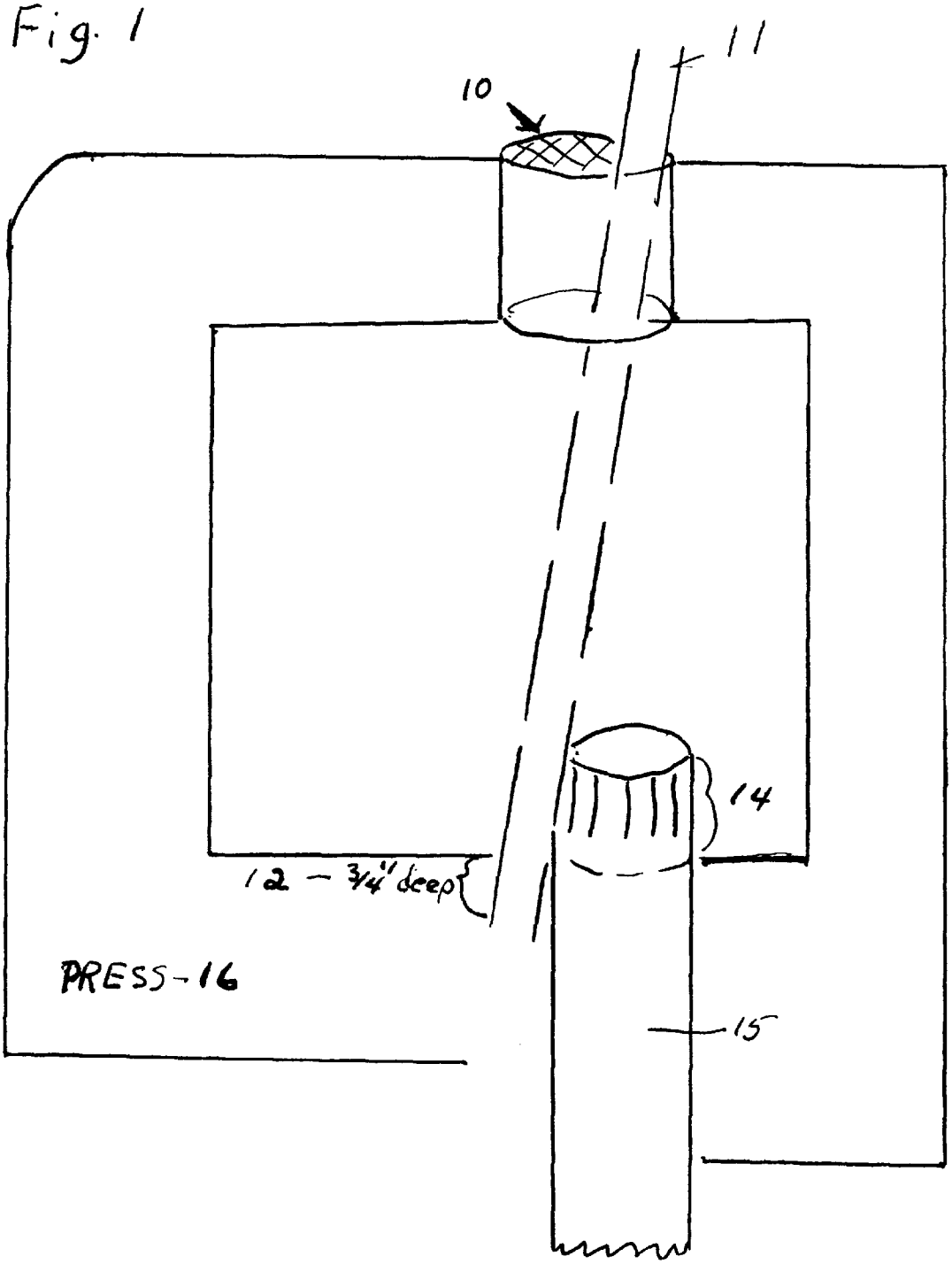
FIG. 1 is a cutaway view of the embodiment of the invention.
Figure 1A:
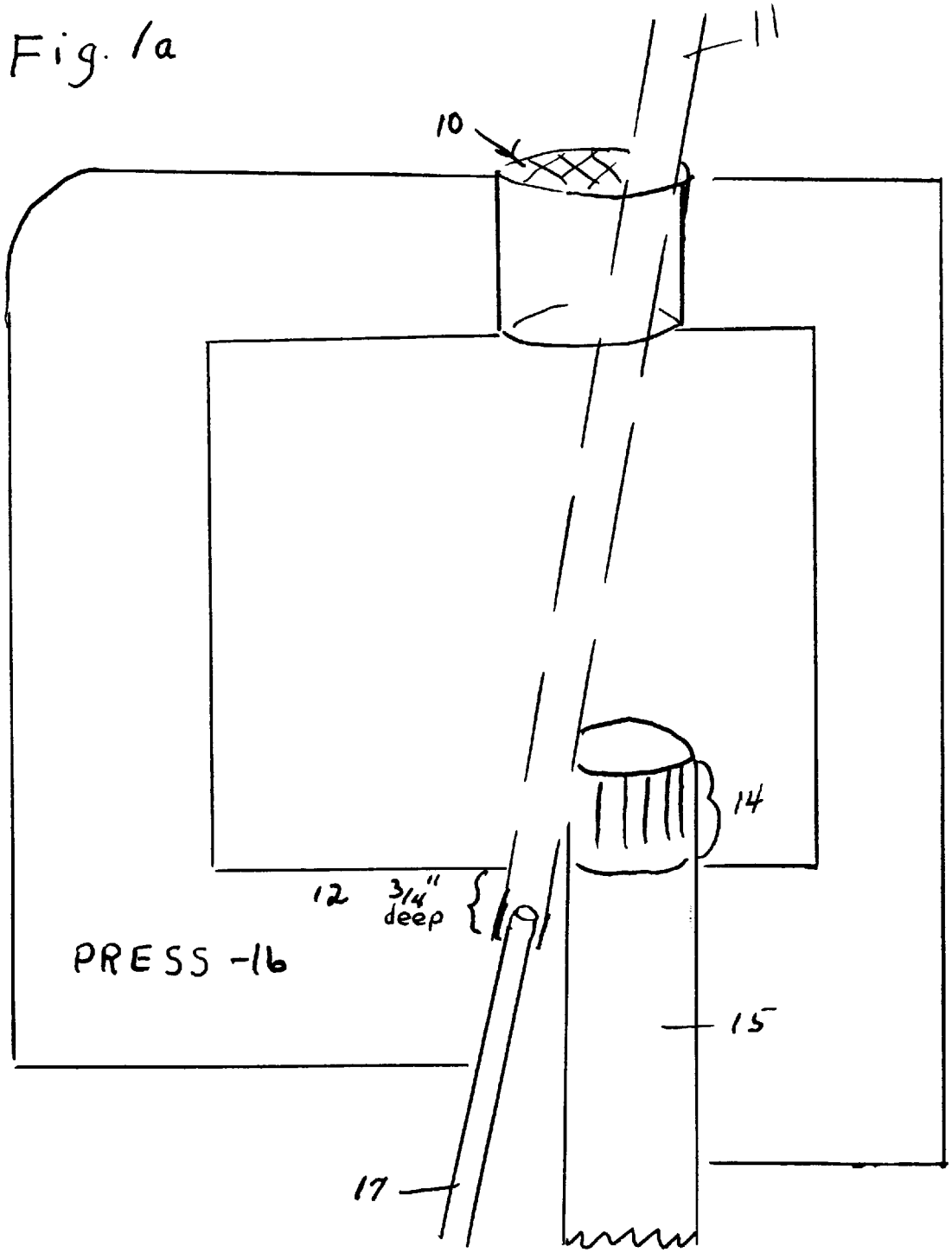
FIG. 1*a* is a cutaway view of the embodiment, showing the addition of the this wall plastic tubing.
Figure 2:
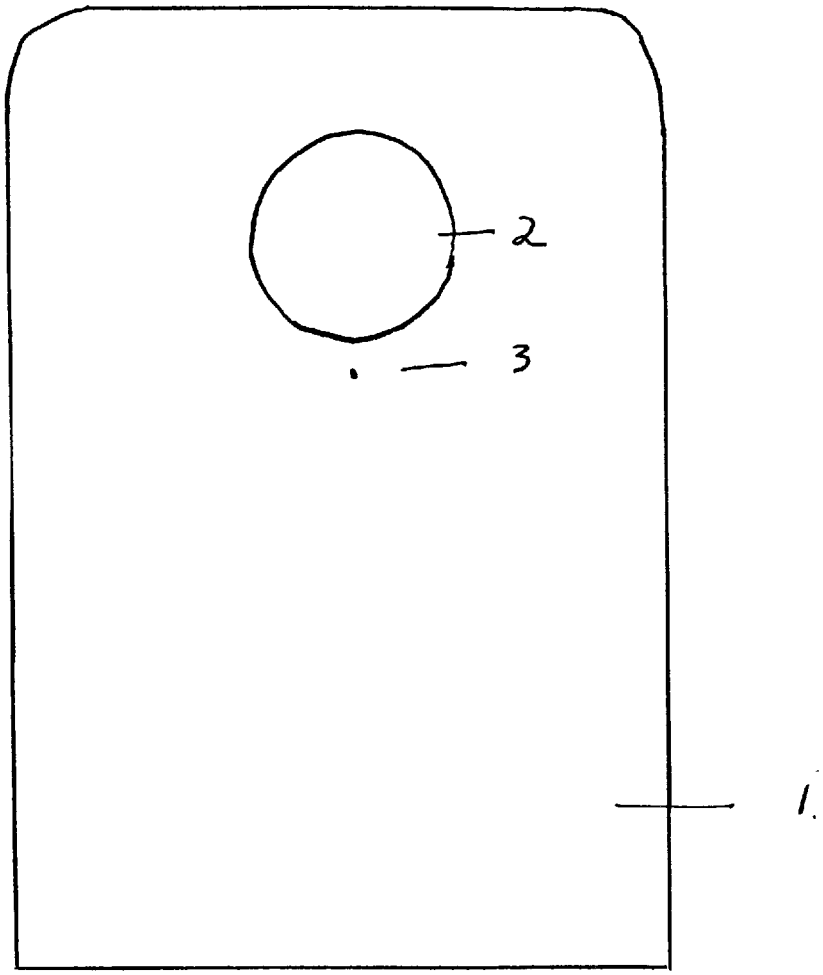
FIG. 2 is a top view of the base of any C or H press.

FIG. 2-1 shows the top view of base of any C or H press.

FIG. 2-2 shows the original ram hole in base of any C or H press.

FIG. 2-3 shows the beginning strike mark for pilot hole ¼" from the original ram hole directly centered in the frame.

Figure 2A:
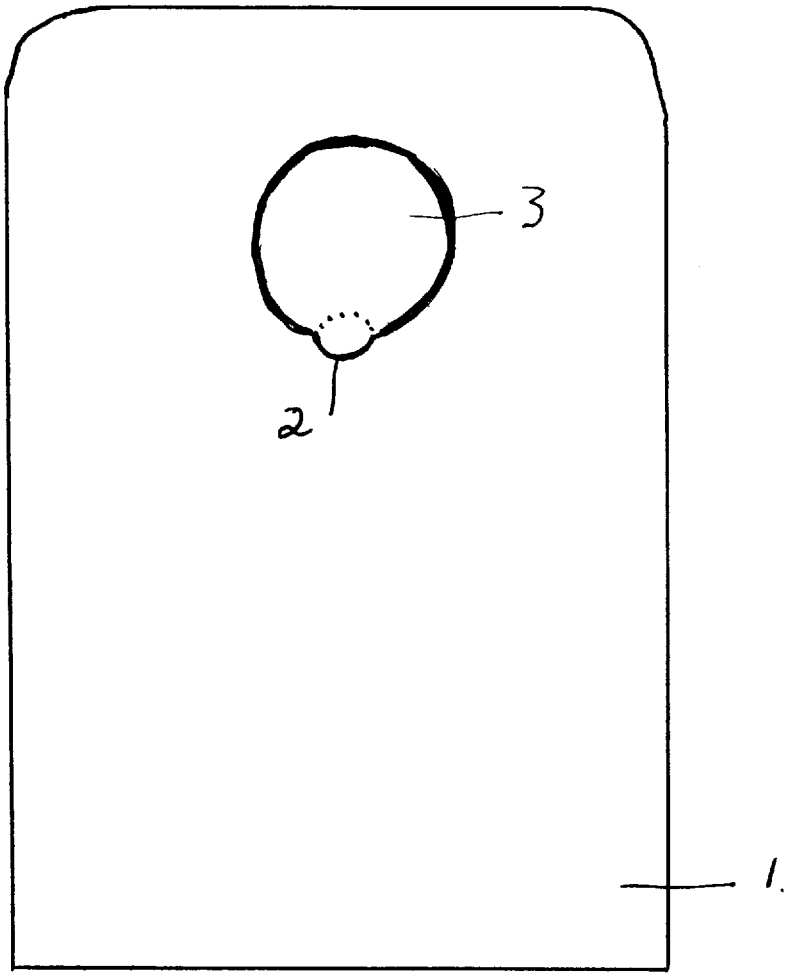
Figure 2B:
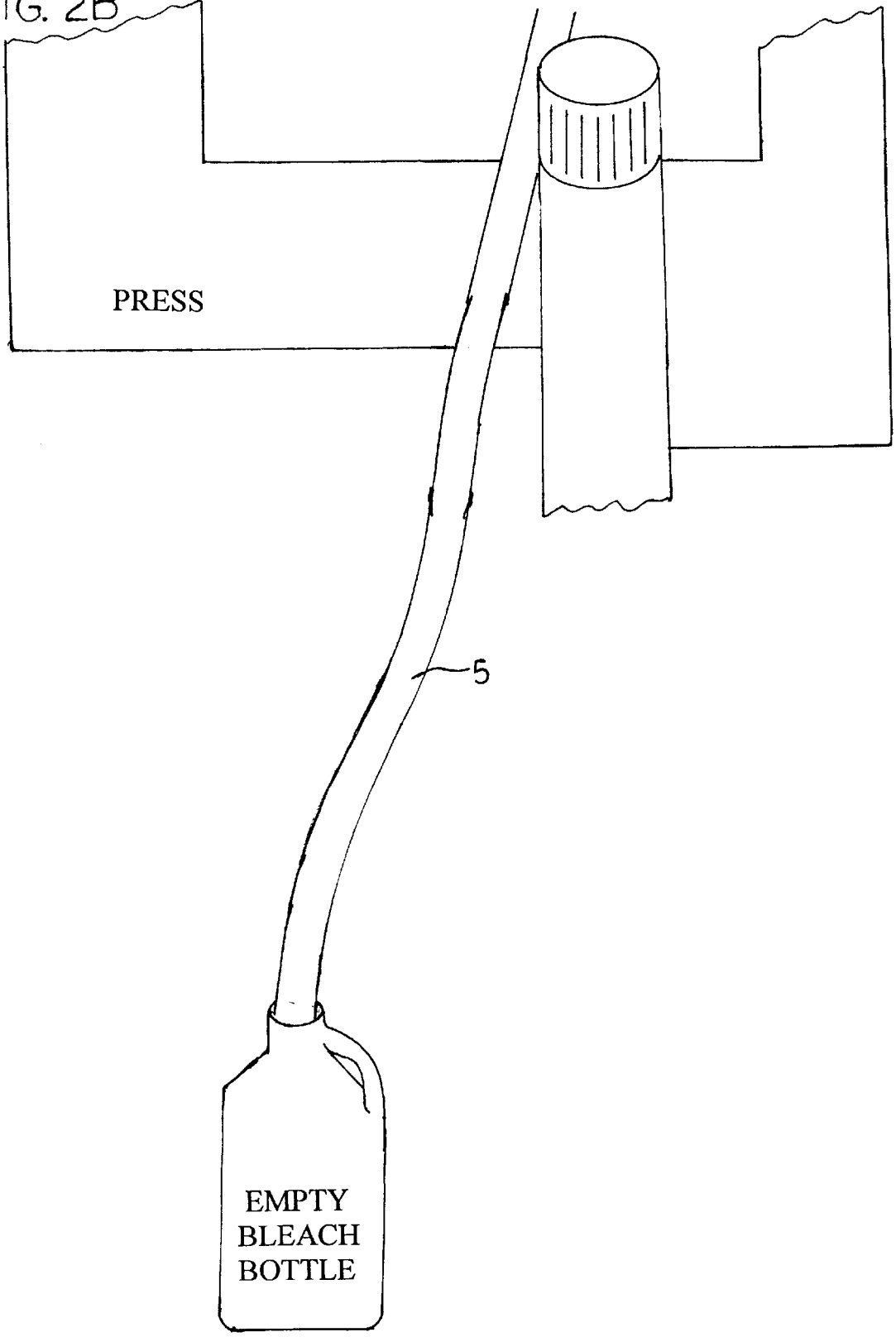
FIG. 2*b* is a cutaway view of the embodiment, showing the thin wall plastic tubing and the receptacle.

FIG. 2*a*-1 shows the top view of base of any C or H press.

FIG. 2*a*-2 shows the ¼" pilot hole drilled clear thru, then enlarged to ½" drill and goes down ¾" into frame of any C or H press. Then the press is turned upside down and counter bored up about ¾" to 1" into primer cup. The plastic tube is inserted in the ½" hole ¾" deep enlarging ram hole at base of C or H press.

FIG. 2*a*-3 shows the original ram hole in any C or H press.

FIG. 2*b*-5 represents the 2" to 3" plastic tube that is attached to the 4" thin wall plastic tube at one end and goes into the empty bleach bottle at the other end.

Operation and Method

Strike a point of beginning ¼ inch in front of the base of ram hole (FIG. 2-3) of any C or H press (FIG. 1-16) with a center punch.

Place a ⅜ inch by 12 inch long drill bit at the strike point (FIG. 2-3) and place next to the die hole (FIG. 1-10) of the press (FIG. 1-16) so as to put the primer hole (FIG. 1-12) in at an 8 degree angle back to front (angle shown FIG. 1-11). Drill.

Then take ½ inch drill 12 inch long and enlarge the ⅜ inch hole (FIG. 1*a*-12) to ½ inch (FIG. 1-12) overlapping ram hole (FIG. 2-2) by ⅛ inch (FIG. 2*a*-2). FIG. 1*a*-11 shows the angle of the drill bit. Only drill down ¾ inch (FIG. 1*a*-12) into the lower part of the press leaving the rest of the hole ⅜ inch. Then insert a 4 inch piece of thin wall tubing (FIG. 1*a*-17) in to the ⅜ inch hole from the bottom of the press. (See FIG. 1*a*-17) Then attach any length you wish (2 ft. to 3 ft.) ⅜ inch clear plastic tubing (FIG. 2*b*-5) to lower end of the 4 inch thin wall tubing. (FIG. 1*a*-17) Then put the lower end of the plastic tubing into any receptacle you wish (empty bleach bottle or quart pop bottle) in order to catch primers, primer debris and fines via gravity down the thin wall plastic tubing (FIG. 1*a*-17) and on down the 2 ft. or 3 ft. plastic tubing (FIG. 2*b*-5). Now replace the ram backwards (180 degrees from original position).

FIG. 2 shows the strike point (FIG. 2-3) of beginning ¼ inch in front of the Ram hole of any C or H press. Strike the point (FIG. 2-3) made with a center punch with a hammer.

FIG. 2*a* shows the Noakes Spent Primer Discharge Hole (FIG. 2*a*-2) from the top as it becomes part of the original ram hole. (FIG. 2*a*-3) The spent primer hole (FIG. 2*a*-2) must overlap the ram hole ⅛ inch in order to catch the primers and debris.

Primers and debris falls via gravity thru clear plastic tube (FIG. 2*b*-5) into the receptacle of your choice. The Broken line (FIG. 1-11) shows the angle of the drill bit in relation to a C or H press.

I claim:

1. The method for facilitating the removal of spent primers from a press having a ram, the method comprising the steps of:

punching a primer hole at a location that is ¼ inch from the front of the location of a ram hole of the press;

drilling the primer hole to a diameter of ⅜ inch by using a drill bit, angling said drill bit at an angle of eight degrees, said angle being measured from the base of the press to the front of the press, and drilling entirely through the press at said angle, drilling the primer hole to a larger diameter of ½ inch, said larger diameter extending downwards to a depth of ¾ inch as measured from the top of the primer hole, leaving the remainder of the primer hole at the ⅜ inch diameter;

inserting a piece of thin wall tubing into the primer hole from the bottom of the press upwards towards the top of the primer hole;

attaching a length of plastic tubing to said thin wall tubing; and extending a lower end of said plastic tubing into a receptacle.

* * * * *